US006001523A

United States Patent [19]

Kemmesat et al.

[11] Patent Number: 6,001,523

[45] Date of Patent: Dec. 14, 1999

[54] ELECTROPHOTOGRAPHIC PHOTOCONDUCTORS

[75] Inventors: Paul Dwight Kemmesat, Longmont; Jennifer Kaye Neely, Arvada; Catherine Mailhé Randolph, Niwot; Kasturi Rangan Srinivasan, Longmont, all of Colo.

[73] Assignee: Lexmark International, Inc., Lexington, Ky.

[21] Appl. No.: 09/182,861

[22] Filed: Oct. 29, 1998

[51] Int. Cl.[6] ..... G03G 5/14

[52] U.S. Cl. ..... 430/96; 430/58.45

[58] Field of Search ..... 430/58.45, 96

[56] References Cited

U.S. PATENT DOCUMENTS

| | | | |
|---|---|---|---|
| Re. 33,724 | 10/1991 | Takei et al. | 430/59 |
| 4,840,861 | 6/1989 | Staudenmayer et al. | 430/59 |
| 4,851,314 | 7/1989 | Yoshihara | 430/59 |
| 5,039,584 | 8/1991 | Odell et al. | 430/58 |
| 5,332,635 | 7/1994 | Tanaka | 430/96 |
| 5,382,489 | 1/1995 | Ojima et al. | 430/96 |
| 5,449,572 | 9/1995 | Ashiya et al. | 430/96 |
| 5,554,473 | 9/1996 | Cais et al. | 430/59 |
| 5,561,016 | 10/1996 | Suzuki et al. | 430/59 |
| 5,569,566 | 10/1996 | Kanayama et al. | 430/58 |
| 5,578,406 | 11/1996 | Ojima et al. | 430/83 |
| 5,585,212 | 12/1996 | Ueda | 430/58 |
| 5,786,119 | 7/1998 | Sorriero et al. | 430/96 |
| 5,874,192 | 2/1999 | Fuller et al. | 430/96 |

FOREIGN PATENT DOCUMENTS

| | | | |
|---|---|---|---|
| 61-62040 | 3/1986 | Japan . | |
| 3-49426 | 7/1991 | Japan | C03G 5/05 |
| 4-78984 | 12/1992 | Japan . | |
| 7-199488 | 8/1995 | Japan . | |
| 7-271060 | 10/1995 | Japan . | |
| 7-271061 | 10/1995 | Japan . | |

*Primary Examiner*—John Goodrow
*Attorney, Agent, or Firm*—John A. Brady

[57] ABSTRACT

The invention described in the specification provides an improved coating for an electrophotographic photoconductor printing system. In particular, a blend of polycarbonate-A and polycarbonate-Z binders according to the formula:

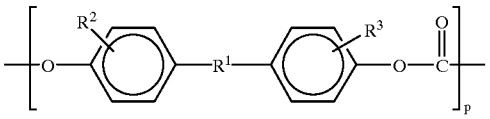

wherein $R^1$ is selected from the group consisting of $CH_2$ an alkylidene group, a cycloalkyl group and a substituted cycloalkyl group, $R^2$ and $R^3$ are selected from the group consisting of hydrogen, halogen and an a $CH_3$ group provides increased durability and wear properties to a charge transport layer coated onto a charge generation layer of a photoreceptor drum. The polycarbonate blend may be used with amine and hydrazone charge transport materials and the charge transport layer may include additional additives which further improve the wear properties of the photoconductor coatings in a laser printer.

41 Claims, No Drawings

ELECTROPHOTOGRAPHIC PHOTOCONDUCTORS

FIELD OF THE INVENTION

The invention relates to photoreceptors for electrophotographic printing/copying machines and more particularly to novel binder compositions for improving the wear properties of charge transport layers (CTL) for such photocopying machines.

BACKGROUND OF THE INVENTION

Electrophotographic machines generally contain an electrophotographic photoconductor comprising a two layer coating of material on a metal substrate or photoreceptor drum. The drum itself may be anodized or may be coated with a sub-layer to assist the adhesion or binding of the two layer coating to the drum.

The two layer coating on the photoreceptor drum is made of a charge generation layer (CGL) and a charge transport layer (CTL). The CGL contains a pigment such as squaraines, phthalocyanines, azo compounds and the like dispersed in a polymeric binder. The CGL provides charge carriers or electron hole pairs upon exposure of the photoreceptor drum to light.

The CTL contains a charge transport material (CTM) selected from arylamines, hydrazones and the like and a polymeric binder material which is coated from a suitable solvent or a mixture of solvents onto the CGL. In some cases, the durability of the two layer coating is improved with a protective overcoat. Because the CTM often does not possess adequate mechanical properties, the polymeric binder is required to impart suitable mechanical properties, such as hardness, abrasion resistance and durability to the CTL. The polymeric binder for the CGL and CTL may be selected from polycarbonate, polyester, polystyrene, polyvinylchloride, polyvinyl acetate, vinyl chloride/vinyl acetate copolymers, polyvinyl acetal, alkyd resin, acrylic resin polyacrylonitrile, polyamide, polyketone, polyacrylamide, butyral resin and the like.

The use of polycarbonate-A (PCA) as a binder for the CTM has been well documented in the literature. PCA is a commercially available engineering thermoplastic, used in a variety of applications. The polymer is inert and affords good mechanical properties to the photoconductor. However, during the life of the photoreceptor drum and photoconductive coating thereon, the polymer exhibits wear under the end-seals in the cartridge containing the drum. This results in the charge-roll making contact with a ground plane of the metal of the photoreceptor drum resulting in arcing. Arcing causes severe print-defects and can shorten the life of the photoreceptor drum and coating.

Polycarbonate-Z (PCZ) has been used as an alternate binder to PCA and PCZ tends to mitigate wear problems associated with the end-seals of the photoreceptor drum. However, the use of PCZ results in wear in the paper area or circumferential surface of the photoreceptor drum in contact with paper thereby causing print-defects. Another problem observed with the use of PCZ is the presence of a high amount of residual solvent in the cured layers on the photoreceptor drum. The residual solvent slowly escapes from the CTL as the drum is used thereby causing the photoconductor coating to fatigue and the residual voltage to increase with drum life which, in turn, disadvantageously decreases the isopel optical density, i.e., the printed copies appear lighter towards the end of the photoreceptor drum life.

Blends of polycarbonates have also been suggested as binders to improve the wear properties of photoconductor coatings. For example, U.S. Pat. No. 4,851,314 to Yoshihara describes use of a mixture of polycorbonates, a high molecular weight polymer having a number average molecular weight (Mn) of 45000 or more and low molecular weight polymer having a Mn of 15000 or less with the low molecular weight polymer being present in an amount ranging from 30 to 95 parts by weight of the composition comprising the high and low molecular weight polymers.

U.S. Pat. No. 5,382,489 to Ojima et al. describes use of a mixture of polycarbonates derived from 4,4'-isopropylidenediphenol (Resin I) having a viscosity-average molecular weight ranging from 30,000 to 90,000 and a polycarbonate derived from 4,4'-cyclohexylidenebisphenol, 4,4'-(1,4-phenylenediisopropylidene)bisphenol or a copolycarbonate based on a diphenylether (Resin II) having a viscosity-average molecular weight ranging from about 20,000 to about 50,000. It is said to be necessary that Resin I have a viscosity molecular weight at least 10,000 to 20,000 higher than that of Resin II.

Despite the resins and combinations of resins suggested for use as binders in for charge transfer layers of electrophotographic machines, there remains a need for improved compositions which dramatically increase the life of the photorecepter drums without adversely affecting the quality of printed copy produced.

It is therefore an object of this invention to provide an improved compositions for use in electrophotographic applications.

Another object of the invention is to provide improved binder compositions for a photoreceptor drum of an electrophotographic machine.

A further object of the invention is to provide a charge transport layer having improved wear properties.

Another object of the invention is to provide a charge transport layer which has a higher tolerance for abrasion both in the paper area and in the seal area of the photoreceptor drum.

Still another object of the invention is to provide a composition which improves the wear properties adjacent the end seals of a photoreceptor drum and which exhibits a relatively longer coating life.

Another object of the invention is to provide an improved photoconductor coating for an electrophotographic machine which exhibits improved wear properties and life without having to increase the coating thickness of the coatings on a photoreceptor drum.

THE INVENTION

With regard to the above and other objects, the invention provides an electrophotographic photoconductor composition including a mixture of polycarbonates each of which are represented by the formula:

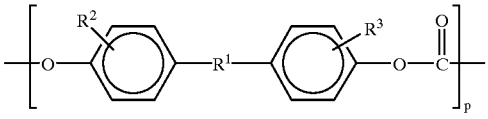

wherein $R^1$ is selected from the group consisting of $CH_2$ an alkylidene group, a cycloalkly group and a substituted cycloalkyl group, $R^2$ and $R^3$ are selected from the group consisting of hydrogen, halogen and a $CH_3$ group, the mixture containing (a) from about 10 to about 75% by weight of a polycarbonate (PCA) therein $R^1$ is an alkyl or an alkylidene group containing from about 1 to about 5 carbon atoms, p is an integer ranging from about 20 to about 200 and the PCA has a polydispersity index of below about 2.5 and (b) from about 25 to about 90% by weight of a polycarbonate (PCZ) wherein $R^1$ is a cycloalkyl group or a substituted cycloalkyl group, the cycloalkyl group containing from about 5 to about 8 carbon atoms, p is an integer ranging from about 15 to about 300 and the PCZ has a polydispersity index of below about 2.5.

In another aspect, the invention provides an electrophotographic photoconductor composition including (a) polycarbonate (PCA) of the formula:

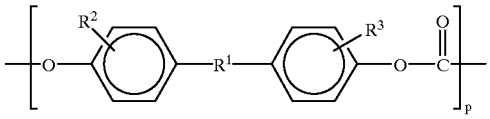

wherein $R^1$ is a methylidene group or an alkylidene group containing from about 3 to about 5 carbon atoms, $R^2$ and $R^3$ are selected from the group consisting of hydrogen, halogen and an a $CH_3$ group and p is an integer ranging from about 20 to about 200 (b) polycarbonate (PCZ) of the formula:

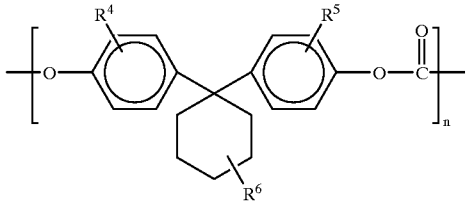

wherein $R^4$, $R^5$ and $R^6$ are selected from the group consisting of hydrogen, $CH_3$ and a halogen and n is an integer ranging from about 15 to about 300, and (c) N,N-diethylaminobenzaldehyde-1,1-diphenylhydrazone (DEH) or tri(p-tolyl)amine.

In yet another aspect, the invention provides an electrophotographic photoconductor composition including (a) polycarbonate (PCA) Of the formula:

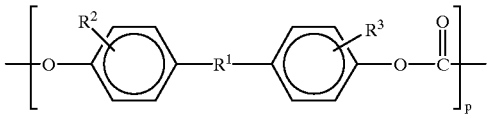

wherein $R^1$ is a methylidene group or an alkylidene group containing from about 3 to about 5 carbon atoms, $R^2$ and $R^3$ are selected from the group consisting of hydrogen, halogen and an a $CH_3$ group and p is an integer ranging from about 20 to about 200, (b) polycarbonate (PCZ) of the formula:

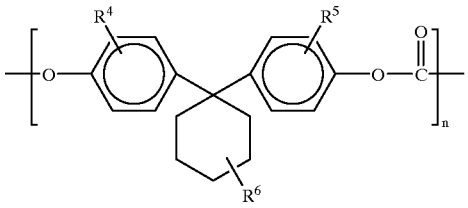

wherein $R^4$, $R^5$ and $R^6$ are selected from the group consisting of hydrogen, $CH_3$ and a halogen and n is an integer ranging from about 20 to about 300, (c) a charge transport material, and (d) an additive selected from a silicone polymer and/or a fluoropolymer.

An advantage of the invention is that blends of polycarbonate polymers according to the invention exhibit significantly improved wear properties and provide significantly longer useful life for the photoconductor coating on the photoreceptor drum in comparison to a PCA binder system. The blends also contribute to a significant increase in the life of the coating on the photoreceptor drum adjacent the end seals without adversely affecting print quality.

An important aspect of the invention relates to the use of a mixture or blend of polycarbonates in the CTL layer of the electrophotographic photoconductor coating. Each of the polycarbonates of the blend or mixture may be represented by the following formula:

(I)

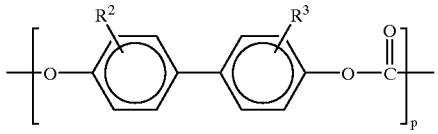

wherein $R^1$ is a $CH_2$ group, an alkylidene group containing from 3 to 5 carbon atoms, a cycloalkyl group or a substituted cycloalkyl group containing from 5 to 8 carbon atoms, each of the $R^2$ and $R^3$ are selected from hydrogen, a halogen and an a $CH_3$ group and p is an integer ranging from about 20 to about 300.

In accordance with the invention, the blend of polycarbonates of formula (I) comprises (1) polycarbonate-A (PCA) wherein $R^1$ is a $CH_2$ group, an alkylidene group containing from 3 to 5 carbon atoms and (2) polycarbonate-Z (PCZ) wherein $R^1$ is a cycloalkyl group or a substituted cycloalkyl group containing from 5 to 8 carbon atoms. It is preferred that the PCA have a number average molecular weight in the range of from about 5,000 to about 50,000, more preferably from about 30,000 to about 35,000 and a polydispersity index of below about 2.5. It is also preferred that the PCZ have a number average molecular weight above about 5,000 and below about 100,000 more preferably from about 35,000 to about 80,000 and a polydispersity index of below about 2.5. Hence, as important feature of the invention is that the PCZ have a molecular weight substantially equal to or higher than the molecular weight of the PCA in the blend and that the molecular weight ratio of PCA/PCZ blend ranges from about 1:1 to about 1:2.6.

In the formula, $R^2$ and $R^3$ of each of the PCA and PCZ are selected from the group consisting of a hydrogen atom, a halogen atom and a $CH_3$ group and may be the same or different. It is preferred, however, that each of the $R^2$ and $R^3$ be hydrogen atoms.

A preferred PCA is a polymer of the formula:

(II)

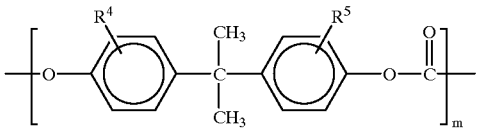

wherein $R^4$ and $R^5$ are selected from the group consisting of hydrogen, $CH_3$ and a halogen and m is an integer ranging from about 20 to about 300.

A preferred PCZ is a polymer of the formula (III)

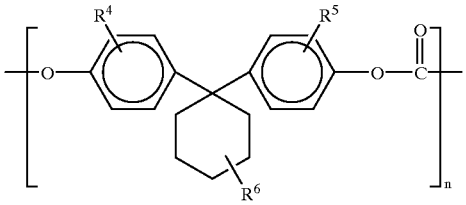

wherein $R^4$, $R^5$ and $R^6$ are selected from the group consisting of hydrogen, $CH_3$ and a halogen and n is an integer ranging from about 20 to about 300.

The amount of PCA and PCZ in the blend or mixture is also another important aspect of the invention. Too much PCA in the blend may result it excessive wear under the end-seals of the photoreceptor drum at the opposing ends of the drum. Too much PCZ in the blend may result in excessive wear around the circumference of the photoreceptor drum in the paper contact area of the drum. Accordingly, it is preferred to use a blend containing from about 10 to about 75 percent by weight of PCA and from about 25 to about 90 percent by weight of PCZ, more preferably, from about 25 to about 75% by weight PCA and from about 25 to about 75% by weight of PCZ. The most preferred blend of PCA and PCZ is from about 20 to about 30 wt. % PCA and from about 70 to about 80 wt. % PCZ.

A blend of PCA and PCZ may be made by dissolving the polycarbonates in a suitable solvent or mixture of solvents selected from tetrahydrofuran, dioxane, benzene, toluene, xylene, chlorobenzene, acetone, methylethylketone, cyclohexanone, esters, halogenated hydrocarbons and the like. The polycarbonates may be dissolved in the solvent one at a time in any order or may be added to the solvent essentially at the same time while stirring the mixture to dissolve the polycarbonates in the solvent. It is not necessary to remove the solvent after making the blend of polycarbonate as the CTL coating formulation may be prepared by adding the charge transport material (CTM) to the solution of mixed binder and solvent.

The components required for an electrophotographic photocotductor system are a charge generation layer (CGL), a charge transport layer (CTL) and a photoreceptor drum coated with the CGL and CTL. The drum is typically a metal substrate material which may include a sublayer to improve adhesion between the two layer coating and the drum surface. In the case of an aluminum drum, the drum may be anodized to provide a suitable subsrate for the two layer coating.

The CGL layer of the photoconductor coating contains organic pigment such as squaraines, phthalocyanines, azo compounds, triarylmethane dyes, thiazine dyes, oxazine dyes, xanthene dyes, cyanine dyes, styryl pigment and the like including inorganic pigments such as selenium, selenium-arsenic, cadmium sulfide, zinc oxide, titanium oxide and organic compounds containing inorganic pigments. The organic and/or inorganic pigments are dispersed in a binder or the pigment and binder are dissolved in a suitable solvent or mixture of solvents and coated onto the drum. The CGL layer is relatively thin and may be less than 1 micron in thickness.

The CTL contains a charge transport material (CTM) and a binder which is coated onto the CGL coating on the drum from a suitable solvent or mixture of solvents. Charge transport materials may be selected from aromatic tertiary amine compounds such as N,N'-bis(3-methylphenyl)-N, N'bisphenylbenzidine, triphenylamine, dibenzylaniline, and tri(p-tolyl)-amine, hydrazone compounds such as N,N-diethylamino benzaldehyde- 1,1 -diphenylhydrazone, oxadiazole derivatives, pyrazoline derivatives, quinazoline derivatives and the like. The CTL layer is typically about 5 to about 40 microns in thickness.

The mechanical properties of the CTL may be further improved by the addition of organic additives in the form of fluorinated polymers or silicones such as polydimethylsiloxane and silicone polymer complexes such as polymethylsilsesquioxane for increased lubrication, or inorganic additives such as silica, titanium oxide and the like.

A preferred additive is a silicone polymer complex known as TOSPEARL. TOSPEARL is a complex silicon structure formed of organic and inorganic silicon compounds which provide a network structure with siloxane bonds extending in three dimensions. TOSPEARL has a spherical appearance and has a mean particle diameter ranging from about 0.1 to about 12.0 microns. Its moisture content at 105° C. is less than 5 percent by weight. TOSPEARL has a true specific gravity at 25° C. of about 1.32 and a bulk specific gravity ranging from about 0.1 to about 0.5. Its specific surface area ranges from about 15 to about 90 $m^2$/gram and has a pH of about 7.5. TOSPEARL is available from D-D Chemical Company, Inc. of Northridge, Calif. under the tradenames TOSPEARL 120A, TOSPEARL 130A and TOSPEARL 145A. TOSPEARL is also available from GE Silicones of New York under the tradenames TOSPEARL 105, TOSPEARL 108, TOSPEARL 120, TOSPEARL 130, TOSPEARL 145, TOSPEARL 3120 and TOSPEARL 240. The amount of TOSPEARL used as an additive preferably ranges from about 1 percent by weight to about 5 percent by weight based on the total weight of the CTL coating layer.

Another preferred additive is a fluoropolymer, preferably, polytetrafluoroethylene. Other fluoropolymers which may be used include, but are not limited to polyvinylidine fluoride and perfluoropolyethers. The amount of fluoropolymer in the CTL coating layer is preferably less than about 5 percent by weight and may range from about 0.5% to about 5.0% by weight based the total weight of the CTL coating layer. The fluoropolymer may be used in addition to or in place of the TOSPEARL additive.

It is desirable to increase the amount of CTM in the CTL in order to improve printing properties. However, high levels of CTM in the CTL can cause problems. For example, when the CTM is tri(p-tolyl)amine (TTA), concentrations of more than 30% by weight in the CTM containing only a PCA type binder results in crystallization of the CTM on the photoreceptor surface or increases the residual voltage. A photoreceptor with a crystallized surface provides non-uniform prints making the photoreceptor unusable. The crystallized material may also hinder cleaning of the photoreceptor by interfering with the cleaning blade. The use of PCZ as a binder reduces the crystallization problem experienced with high concentrations of TTA in the CTL, however, as described above, higher levels of PCZ decrease the resistance of the photoreceptor drum to scratching in the paper area. Surprisingly, the use of a PCA/PCZ blend as described above with the TTA was found to significantly reduce crystallization of the TTA in the CTL and also significantly reduce scratches on the drum in the paper area. An unexpeceted advantage found by use of a PCA/PCZ blend with TTA is that the print stability of the drum over the life of the coating is significantly improved as compared to a pure PCZ binder.

The following non-limiting examples provide further illustration of various aspects of the invention. In the following examples, the molecular weights and polydispersities of the PCA and PCZ compounds used as binder resins for the CTL coating layers are given in the table.

TABLE 1

| Polycarbonate | Number Average Molecular Weight ($M_n$) | Weight Average Molecular Weight ($M_w$) | Polydispersity Index ($M_n/M_w$) |
|---|---|---|---|
| PCA MAKROLON-5208 | 34,433 | 71,360 | 2.07 |
| PCZ, IUPILON-200Z | 19,100 | 77,200 | 2.69 |
| PCZ, PCZ-2020 | 26,700 | 53,000 | 1.99 |
| PCZ, IUPILON-400Z | 47,200 | 101,200 | 2.14 |
| PCZ, PCZ-2040 | 56,100 | 107,400 | 1.91 |

In the foregoing table, the PCA was obtained from Bayer of Pittsburgh, Pa., the PCZ-2020 and 2040 were obtained from Esprit Chemicals of Florida and the IUPILON-200Z and -400Z were obtained from Mitsubishi Gas Chemical of New York.

EXAMPLE 1

A Type-IV charge transport layer (CGL) coating was prepared by adding 7.4 grams of oxotitanium phthalocyanine, 9.0 grams of polyvinylbutyral (BX-55Z fom Sekisui Chemical Co. of New York) and 60 milliliters of Potter's glass beads to a mixture of 50 grams of 2-butanone and 50 grams of cyclohexanone in an amber glass bottle. The mixture was agitated in a paint-shaker for 12 hours and diluted to about 3% by weight solids with 400 grams of 2-butanone to provide a CG formulation. Anodized aluminum drums were dip-coated with the CG formulation and dried at 100° C. for 5 minutes.

A charge transport layer (CTL) formulation was prepared from 62.3 grams of polycarbonate-A (MAKROLON-5208), 26.7 grams of benzidine in a solution of 249 grams of tetrahydrofuran (THF) and 106 grams of 1,4-dioxane. One of the CG layer coated drums was dip-coated in the CT formulation and dried at 120° C. for 1 hour to obtain a coating weight of about 19 mg/in$^2$.

EXAMPLE 2

An anodized aluminum drum was dip-coated with the CG formulation from Example 1 and dried at 100° C. for 5 minutes. A CT formulation was prepared from a solution containing 62.3 grams polycarbonate-Z (PCZ) (I-400Z), 26.7 grams of N,N'-bis(3-methyl-phenyl)-N,N'-bisphenylbenzidine (TPD) in a solution of 304 grams of tetrahydrofuran (THF) and 101 grams of 1,4-dioxane. One of the CG layer coated drums was dip-coated in the CT formulation and dried at 120° C. for 1 hour to obtain a coating weight of about 19.1 mg/in$^2$.

EXAMPLE 3

An anodized aluminum drum was dip-coated with the CG formulaton of Example 1 and dried at 100° C. for 5 minutes. A CT formulation was prepared from a 46.73 grams PCA (MAKROLON-5208), 15.57 grams of PCZ (IUPILON-400Z), 26.7 grams of TPD in a solution of 283.5 grams of THF and 121.5 grams of 1,4-dioxane. One of the CG layer coated drums was dip-coated in the CT formulation and dried at 120° C. for 1 hour to obtain a coating weight of about 18.2 mg/in$^2$.

EXAMPLE 4

An anodized aluminum drum was dip-coated with the CG formulation from Example 1 and dried at 100° C. for 5 minutes. A CT formulation was prepared from a 15.57 grams of PCA (MAKROLON-5208), 46.73 grams of PCZ (IUPILON-400Z), 26.7 grams of TPD in a solution of 283.5 grams of THF and 121.5 grams of 1,4-dioxane. One of the CG layer coated drum was dip-coated in the CT formulation and dried at 120° C. for 1 hour to obtain a coating weight of about 20 mg/in$^2$.

EXAMPLE 5

An anodized aluminum drum was dip-coated with the CG formulation of Example 1 and dried at 100° C. for 5 minutes. A CT formulation was prepared from a 33.75 grams PCA (MAKROLON-5208), 11.25 grams of PCZ (IUPILON-400Z), 30 grams of N,N-diethylamino benzaldehyde-1,1-diphenylhydrazone (DEH) in a solution of 274.6 grams of THF, 91.5 grams of 1,4-dioxane, 0.75 grams of savinyl yellow and 4 drops of a surfactant (DC-200 polydimethylsiloxane). One of the CG layer coated drums was dip-coated in the CT formulation and dried at 120° C. for 1 hour to obtain a coating weight of about 16 mg/in$^2$.

EXAMPLE 6

An anodized aluminum drum was dip-coated with the CG formulation of Example 1 and dried at 100° C. for 5 minutes. A CT formulation was prepared from a 22.5 grams PCA, 22.5 grams of PCZ (IUPILON-400Z), 30 grains of N,N-diethylamino benzaldehyde-1,1-diphenylhydrazone (DEH) in a solution of 274.6 grams of THF, 91.5 grams of 1,4-dioxane, 0.75 grams of savinyl yellow and 4 drops of a surfactant (DC-200 polydimethylsiloxane). One of the CG layer coated drums was dip-coated in the CT formulation and dried at 120° C. for 1 hour to obtain a coating weight of about 15.5 mg/in$^2$.

EXAMPLE 7

An anodized aluminum drum was dip-coated with the CG formulation of Example 1 and dried at 100° C. for 5 minutes. A CT formulation was prepared from a 11.25 grams PCA (MAKROLON-5208), 37.5 grams of PCZ (IUPILON-400Z), 30 grams of N,N-diethylamino benzaldehyde-1,1-diphenylhydrazone (DEH) in a solution of 274.6 grams of THF, 91.5 grams of 1,4-dioxane, 0.75 grams of savinyl yellow and 4 drops of a surfactant (DC-200 polydimethylsiloxane). One of the CG layer coated drums was dip-coated in the CT formulation and dried at 120° C. for 1 hour to obtain a coating weight of about 17.1 mg/in$^2$.

EXAMPLE 8

An anodized aluminum drum was dip-coated with the CG formulation of Example 1 and dried at 100° C. for 5 minutes. A CT formulation was prepared from a 28.0 grams PCA (MAKROLON-5208) containing 10% by weight polytetrafluoroethylene (PTFE) (LS-2010 from Mitsubishi Gas Chemicals of New York), 285.0 grams of PCZ (IUPILON-400Z), 24 grams of TPD in a solution of 273.3 grams of THF, 91.1 grams of 1,4-dioxane and 4 drops of a surfactant (DC-200 polydimethylsiloxane). One of the CG layer coated drums was dip-coated in the CT formulation and dried at 120° C. for 1 hour to obtain a coating weight of about 17.3 mg/in$^2$.

EXAMPLE 9

A Type-IV charge transport layer (CGL) coating was prepared by adding 7.0 grams of oxotitanium phthalocyanine, 3.25 grams of polyvinylbutyral (BX-55Z), 9.75 grams epoxy resin (Epon 1009 from Shell Chemical Company of Houston, Tex.) and 50 milliliters of Potter's glass beads to a mixture of 80 grams of 2-butanone and 31 grams of cyclohexanone in an amber glass bottle. The mixture was agitated in a paint-shaker for 12 hours and diluted to about 6.5% by weight solids with 202 grams of 2-butanone to provide a CG formulation.

Anodized aluminum drums were dip-coated with the CG formulation and dried at 100° C. for 5 minutes.

A CT formulation was prepared from a 46.73 grams PCA (MAKROLON-5208), 15.57 grams of PCZ (IUPILON-400Z), 26.7 grams of TPD in a solution of 283.5 grams of THF and 121.5 grams of 1,4-dioxane. One of the CG layer coated drums was dip-coated in the CT formulation and dried at 120° C. for 1 hour to obtain a coating weight of about 18.4 mg/in$^2$.

EXAMPLE 10

An anodized aluminum drum was dip-coated with the CG formulation from Example 9 and dried at 100° C. for 5 minutes. A CT formulation was prepared from a 15.57 grams of PCA (MAKROLON-5208), 46.73 grams of PCZ (IUPILON-400Z), 26.7 grams of TPD in a solution of 283.5 grams of THF and 121.5 grams of 1,4-dioxane. One of the CG layer coated drum was dip-coated in the CT formulation and dried at 120° C. for 1 hour to obtain a coating weight of about 19.1 mg/in$^2$.

EXAMPLE 11

Binder blends of PCA (MAKROLON-5208) and/or PCZ having number average molecular weights ($M_n$) of about 20000 (IUPILON-200Z) and about 40000 or about 47000 (IUPILON-400Z) were made by dissolving PCA and/or PCZ one at a time in a solution of THF and 1,4-dioxane according to examples 1–10. CT coating formulations based on different blend concenrations of PCA and PCZ were prepared. The weight ratios of PCA to PCZ in the blends were as follows: 100/0, 90/10, 75/25; 50/50, 25/75 and 0/100.

Preliminary screenings of the blends were carried out by coating the CT formulations on a mylar film previously coated with the CG formulation. The film was then subjected to abrasion in a Taber Abraser Model 503 under a 750 gram weight. The wear on the film surface was estimated by observing the weight loss of the coated mylar film after more than 1000 cycles. All experiments were run for 3000 cycles, and the results presented in the following table correspond to an average weight loss in grams per 1000 cycles.

TABLE 2

| Run # | PCA (%) | PCZ % ($M_n$ ~ 20 K) | PCA % ($M_n$ ~ 40 K) | Wear (mg/l K cycles) |
|---|---|---|---|---|
| 1 | 100 | 0 | 0 | 6.44 |
| 2 | 90 | 10 | 0 | 6.34 |
| 3 | 75 | 25 | 0 | 6.13 |
| 4 | 90 | 0 | 10 | 5.83 |

Results of the foregoing runs indicated that blends of PCA and PCZ may improve the wear of the coating on the photoreceptor drum. Also, the higher the molecular weight of the PCZ used in the blend the more improved is the wear resistance of the CTL coating as compared to the wear resulting from the use of a lower molecular weight PCZ in the blend. Accordingly, it was found that a blend of PCA and PCZ improved the wear resistance of a CTL coating over a CTL coating which contained only PCA as a binder, and that use of a PCZ in the blend having a higher molecular weight than the PCA gave the best results.

EXAMPLE 12

Since the Taber Abraser tester does not account for the effect of toner or paper on the life of the photoreceptor drums, drums were coated with the formulations of Examples 1–4and were life-tested in an OPTRA-S laser printer from Lexmark International of Lexington, Ky. having a 780 nm laser and an expose-to-develop time of 110 milliseconds. The coated drums were evaluated for print-quality and for coating wear in the paper area and at the edges of the drum. The results of the life cycle tests with drums coated according to Examples 1–4 are given in Table 3. The PCA/PCZ blend coating in Table 4 was prepared according to Example 9. The 100% PCA and 100% PCZ binder coated drums were prepared generally in accordance with Examples 1 and 2.

PC end wear given in Tables 3 and 4 corresponds to the wear through of the coating under the end-seals adjacent the coating on the photoconductor (PC) drum of the cartridge. The end-seal used in the OPTRA-S printer was a polyacetal wheel which rides on the surface of the drum. As the wear through of the coating increases over the life of the drum, coating wear leads to either a charge-roll arcing or delamination of the coating from the metal substrate, thereby reducing the useful life of the PC drum. The change in voltage from the beginning to the end of life of the drum is an indication of the coating wear. Accordingly, small changes in the voltage indicate less coating wear.

TABLE 3

| CTL Binder weight ratio PCA/PCZ | Charge voltage (−V), SOL/EOL | Isopel Discharge voltage (−V) SOL/EOL[1] | All Black Discharge voltage (−V) SOL/EOL | Coating Wear Paper Area | Coating Wear End Seal Area[2] |
|---|---|---|---|---|---|
| 100/0 | 873/806 | 436/490 | 100/100 | No | Yes |
| 100/0 | 870/917 | 410/483 | 80/73 | No | Yes |
| 75/25 | 850/857 | 425/470 | 142/163 | Yes | No |
| 25/75 | 853/853 | 373/433 | 117/177 | slight | No |
| 25/75 | 860/863 | 383/437 | 95/147 | slight | No |

TABLE 3-continued

| CTL Binder weight ratio PCA/PCZ | Charge voltage (−V), SOL/EOL | Isopel Discharge voltage (−V) SOL/EOL[1] | All Black Discharge voltage (−V) SOL/EOL | Coating Wear Paper Area | Coating Wear End Seal Area[2] |
|---|---|---|---|---|---|
| 0/100 | 870/833 | 440/523 | 90/103 | Yes | No |
| 0/100 | 873/880 | 453/497 | 126/133 | Yes | No |

[1]SOL/EOL corresponds to the start of life (SOL) of the photoreceptor drum with 0 prints and to the end of the life (EOL) of the drum after about 35,000 prints.

[2]End seal area wear means the photoconductor coating wear on the drum under the ends seals of the cartridge.

The Isopel Discharge voltage in the foregoing and following tables is the voltage required to print an image at a laser energy of about 0.2 microjoules/cm$^2$. The voltage is measured using electrostatic probes and varying the laser energy while recording the discharge voltage with respect to the laser energy level.

The foregoing runs show that a CTL layer containing 100% PCA as a binder wore through to the core in the end seal area of the coating whereas a CTL layer containing a binder which was 100% PCZ exhibited little or no wear under the end seals. On the other hand, a 100% PCA binder coating exhibited little or no paper area wear whereas, the 100% PCZ binder coating was prone to scratching or abrasion of the coating in the paper contact area of the drum.

In comparison, a CTL coating containing a blend of 25% PCA and 70%PCZ binder reduced PC end wear and paper area wear of the photoconductor coating on the drum. Furthermore, the use of blends of PCA and PCZ in the CTL coating layer did not adversely affect the overall electrical sensitivity of the drum.

EXAMPLE 13

The effect of PCZ molecular weight on the binders for the CTL coating layers was illustrated by preparing binders containing PCA (MAKROLON-5208) and blends of PCA and PCZ, the PCZ having number average molecular weights ($M_n$) of 20000 and 40000 and 80000. The blends were made by dissolving PCA and/or PCZ one at a time in a solution of THF and 1,4-dioxane according to examples 1–10. The voltage and wear properties of CG coated drums of Example 13 are given in the following Table.

TABLE 4

| CTL Binder weight ratio PCA/PCZ | PCZ ($M_n$) | Charge voltage (−V), SOL/EOL | All Black Discharge voltage (−V), SOL/EOL | Isopel Discharge voltage (−V) SOL/EOL | Isopel OD SOL/Avg. | Coating Wear Paper area | Coating Wear End Seal Area |
|---|---|---|---|---|---|---|---|
| 100/0 | — | 891/928 | 113/123 | 448/571 | 0.82/0.68 | Yes | Moderate |
| 75/25 | 20000 | 857/880 | 153/168 | 514/554 | 0.81/0.76 | Yes | Severe |
| 75/25 | 40000 | 850/857 | 142/163 | 425/470 | 0.71/0.62 | No | No |
| 25/75 | 40000 | 853/853 | 117/177 | 373/433 | 0.88/0.60 | slight | No |
| 75/25 | 80000 | 825/905 | 187/184 | 466/541 | 0.60/0.52 | severe | No |

The isopel optical density for the runs was determined using a Hewlet Packard SCANJET ADF scanner previously calibrated to a Gardner COLORGARD System densitometer. The scanner was used to read reflected light from the printed pages by correlating the readings to density measurements of a calibration set of pages corresponding to various shades of gray ranging from all white to all black.

In order to determine optical density, a solid fill area was printed at the start of life (SOL) of the photoreceptor drum. The reflection density of five points at least 2 millimeters apart in the filled areas was determined with the scanner. The five readings were then averaged and used as the SOL reading. Filled areas were prepared during the life of the coating on the drum at zero pages printed (start of life) and every 2000 pages printed to the end-of-life (about 25,000 printed pages) and the density readings were averaged. Higher numbers for the OD represented more black in the printed areas and lower numbers represented more white in the printed areas. It is preferred that the OD be in the range of from about 0.4 to about 0.6 which represents a gray scale reflectance of the print. The results are given in column 6 in the above table.

As shown in the foregoing table, blends of PCA and PCZ with the PCZ having a higher number average molecular weight than that of the PCA provides a coating which exhibits no end area wear after about 25,000 ages are printed. As long as the number average molecular weight of the PCZ is lower than about 80,000, blends of PCA and PCZ also exhibit little or no wear in the paper area of the coated drum. In comparison, use of PCA alone as a binder or PCA with a higher molecular weight than that of the PCZ in the binder composition exhibits significantly more coating wear in the paper area and end area of the drum.

EXAMPLE 14

The effect of the use of additives such as silicone polymers and fluorocarbon polymers in the CTL coating layers was determined by combining a silicone or fluorocarbon polymer with the CT coating formulations containing PCA or a blend of PCA and PCZ as a binder resin. In a first series of runs, a CT formulation was prepared by mixing 2.04 grams of TOSPEARL 120 having a mean particle diameter of about 2 microns with the CT coating formulation prepared generally in accordance with Examples 1 and 3 above. The CT coating formulations were applied to CG coated drums. The results are given in the following table.

TABLE 5

| CTL Binder | TOSPEA | Thickness of Coating | | Coating Wear | |
|---|---|---|---|---|---|
| weight ratio PCA/PCZ | RL (wt. %) | EOL (microns) | Isopel OD | Paper area | End Seal Area |
| 100/0 | 0 | 20.1 | 0.68 | Slight | Yes |
| 100/0 | 2.3 | 18.7 | 0.56 | Moderate | Yes |
| 75/25 | 0 | 21.2 | 0.84 | Slight | No |
| 75/25 | 2.3 | 20.6 | 0.47 | Moderate | Slight Top |

As shown in the foregoing table, TOSPEARL silicone microspheres improve the print quality through the life of the drum (Isopel OD) thereby stabilizing the optical density of the printed images over the coating life. Hence, a combination of the binder blend of PCA and PCZ with TOSPEARL results in improved wearability of the coating in the end seal areas and improved print quality over the coating life.

EXAMPLE 15

In the following run, a CT formulation containing fluoropolymers and a blend of polycarbonates was coated onto a CG coated drum as described above in Example 8. The CT formulation contained 35% by weight of PCZ (IUPILON-400Z) and 35% by weight of PCA (MAKROLON-5208) containing 10% by weight polytetrafluoroethylene (PTFE) available from Misubishi Gas Chemical under the tradename LS-2010.The CT formulation also contained 30% by weight TPD. The CG formulation on the drum contained 45% by weight oxytitanium phthalocyanine and 55% by weight polyvinylbutyral. The coated photoreceptor drum was placed in an OPTRA-S laser printer and run for 24,000 print cycles.

The drum exhibited no end-seal wear of the coating and very slight paper area coating wear. There was no significant electrical fatigue. The initial and final discharge voltages at 0 print cycles and 24,000 print cycles, respectively were −900 V/−144 V and −916 V/−150 V. The discharge voltages indicate no print-darkening through the life of the coating. As shown above in Table 5, the control drum containing only PCA binder in the CT coating layer exhibited significant end-seal coating wear over the life of the coating.

EXAMPLE 16

The effect of polycarbonate blends was evaluated in hydrazone (DEH) and TPD transport systems for the CTM of the CT coating layer. CT layer coating formulations containing PCA and/or PCZ were evaluated on Type IV ard Type I titanyl phthalocyanine (TiOPc) charge generation systems Tables 6 and 7 respectively. The blends of PCA/PCZ were prepared according to Examples 5, 6 and 7 above.

TABLE 6

| CTL Binder weight ratio PCA/PCZ | CG Pigment (%); Binder | TiOPc Type | Charge Voltage (−V), SOL/EOL | All Black Discharge Voltage (−V) SOL/EOL |
|---|---|---|---|---|
| 100/0 | 45% TiOPc; BX-55Z | Type IV | 950/873 | 187/143 |
| 75/25 | 45% TiOPc; BX-55Z | Type IV | 935/880 | 180/163 |
| 50/50 | 45% TiOPc; BX-55Z | Type IV | 881/880 | 175/178 |
| 25/75 | 45% TiOPc; BX-55Z | Type IV | 922/889 | 240/181 |

As shown in the foregoing table, blends of PCA and PCZ binders in combination with DEH exhibited improved fatigue and a lower change in the charge voltages from the beginning of life to the end of the coating when used as a CT coating on a Type I CG coating.

TABLE 7

| CTL Binder weight ratio PCA/PCZ | Charge Transport Molecule | TiOPc Type | Discharge Voltage (−V) @ 0 Printed pages | Discharge Voltage (−V) @ 18,000 Printed pages | Change in Discharge Voltage Over Life (−V) |
|---|---|---|---|---|---|
| 100/0 | TPD | Type I | 228 | 158 | 70 |
| 50/50 | TPD | Type I | 237 | 199 | 38 |
| 25/75 | TPD | Type I | 240 | 201 | 39 |
| 0/100 | TPD | Type I | 172 | 110 | 58 |
| 100/0 | DEH | Type I | 228 | 158 | 70 |
| 50/50 | DEH | Type I | 236 | 180 | 56 |
| 0/100 | DEH | Type I | 230 | 173 | 57 |

As shown in the foregoing table, for TPD charge transport materials, blends of 50% by weight PCA and PCZ and 25 wt. % PCA with 75 wt. % PCZ exhibited significantly lower voltage change over the life of the coating on the drum than either the 100 wt. % PCA binder or the 100 wt. % PCZ binder and the discharge voltages after 18,000 print cycles for binder blend coated drums remained high even after 18,000 print cycles. Likewise, a CT layer containing a blend of PCA and PCZ as the binder exhibited a higher discharge voltage and lower change in voltage over the life of the coating than either the pure PCA or pure PCZ binder containing coatings.

EXAMPLE 17

The effect of the use of tri(p-tolyl)amine (TTA) as a charge transport material in the CTL was evaluated for concentrations of TTA above 30 wt. % using a pure PCA binder, a copolycarbonate binder and a mixture of PCA and PCZ binders. Anodized aluminum drums were dip-coated with the CG formulation of Example 1 and dried at 100° C. for 5 minutes then dip-coated with the CT formulations of Examples 17–19.

A charge transport layer (CT) formulation was prepared from 66.0 grams of co-polycarbonate of 1,1-bis(4-hydroxyphenyl)-3,3,5-trimethylcyclohexane and 2,2-bis(4-hydroxyphenyl)propane available from Bayer under the tradename APEC-9201 and 44 grams of TTA in a solution of 321 grams of THF and 4 drops of surfactant (DC-200 polydimethylsiloxane). One of the CG layer coated drums was dip-coated in the CT formulation and dried at 120° C. for one hour to obtain a coating weight of about 16.68 mg/in$^2$.

EXAMPLE 18

A charge transport layer (CT) formulation was prepared from 48.0 grams of PCA (MAKROLON-5208), 16.0 grams of PCZ (IUPILON-400Z), 34.46 grams of TTA in a solution of 321 grams of THF, 96 grams 1,4-dioxane and 4 drops of surfactant (DC-200 polydimethylsiloxane). One of the CG layer coated drums was dip-coated in the CT formulation and dried at 120 ° C. for one hour to obtain a coating weight of about 15.72 mg/in2.

EXAMPLE 19

A charge transport layer (CT) formulation was prepared from 16.0 grams of PCA (MAKROLON-5208), 48.0 grams of PCZ (IUPILON-400Z), 42.67 grams of TTA in a solution of 321 grams of THF, 96 grams 1,4-dioxane and 4 drops of surfactant (DC-200 polydimethylsiloxane). One of the CG layer coated drums was dip-coated in the CT formulation and dried at 120° C. for one hour to obtain a coating weight of about 17.30 mg/in$^2$.

The following table provides comparative results of drums coated according to the foregoing Examples 17–19 with respect to crystallization, paper count, charge and discharge voltages and paper area wear for the coated drums.

TABLE 8

| Sample No. | TTA wt. % | Binder or PCA/PCZ (wt. ratio) | Crystallization | Page Count | Charge Voltage (SOL/EOL) | Discharge Voltage (SOL/EOL) | Paper Area Wear |
|---|---|---|---|---|---|---|---|
| 1 | 40 | 100/0 | Yes | — | — | — | — |
| 2 | 35 | Control[1] | No | 29,500 | 933/816 | 171/138 | Slight |
| 3 | 40 | Control[1] | No | 32,000 | 921/908 | 144/158 | Slight |
| 4 | 35 | 25/75 | No | 26,904 | 896/871 | 175/175 | No |
| 5 | 40 | 25/75 | No | 27,596 | 873/872 | 153/154 | No |
| 6 | 35 | 75/25 | No | 30,140 | 899/918 | 190/209 | No |
| 7 | 40 | 75/25 | No | 26,708 | 878/872 | 232/213 | No |

[1]Control was APEC-9201 binder.

As can be seen by the foregoing comparative examples, a photoreceptor containing TTA in the CTL (Sample #'s 4–7) performed best when the binder was a PCA/PCZ mixture. The coating exhibited stable electricals (print-quality) and no wear in the paper area of the drum. The Sample 1 drum containing TTA and 100 wt. % PCA could not be run because crystallization of the TTA on the drum surface. The control examples (Samples 2–3) exhibited slight wear in the paper area and thus were inferior to the samples containing the PCA/PCZ binder mixture.

In the following examples, the effect of the use of tri(p-tolyl)amine (TTA) as a charge transport material in the CTL was evaluated for concentrations of TTA above 30 wt. % using a copolycarbonate binder, a mixture of PCA and PCZ binders and, a pure PCZ binder. Anodized aluminum drums were dip-coated with three different batches of CG formulations as described in Example 1 with the exception that the CG dispersions were prepared in a mill rather than in a paint shaker. The CG coated drums were dried at 100° C. for 5 minutes then dip-coated with the CT formulations of Examples 20–31.

EXAMPLE 20

A charge transport layer (CT) formulation was prepared from 66.0 grams of co-polycarbonate of 1,1-bis(4-hydroxyphenyl)-3,3,5-trimethylcylohexane and 2,2-bis(4-hydroxyphenyl)propane available from Bayer under the tradename APEC-9201 and 44 grams of TTA in a solution of 321 grams of THF and 4 drops of surfactant (DC-200 polydimethylsiloxane). Two of the CG layer coated drums were dip-coated in the CT formulation and dried at 120° C. for one hour to obtain coating weights of about 15.43 and 16.17 mg/in$^2$.

EXAMPLE 21

A charge transport layer (CT) formulation was prepared from 66.0 grams of co-polycarbonate of 1,1-bis(4-hydroxyphenyl)-3,3,5-trimethylcyclohexane and 2,2-bis(4-hydroxyphenyl)propane available from Bayer under the tradename APEC-9201 and 36 grams of TTA in a solution of 321 grams of THF and 4 drops of surfactant (DC-200 polydimethylsiloxane). Two of the CG layer coated drums were dip-coated in the CT formulation and dried at 120° C. for one hour to obtain coating weights of about 16.16 and 16.66 mg/in$^2$.

EXAMPLE 22

A charge transport layer (CT) formulation was prepared from 48.0 grams of PCA (MAKROLON-5208), 16.0 grams of PCZ (IUPILON-400Z), 42.67 grams of TTA in a solution of 350 grams of THF, 96 grams 1,4-dioxane and 4 drops of surfactant (DC-200 polydimethylsiloxane). One of the CG layer coated drums was dip-coated in the CT formulation and dried at 120° C. for one hour to obtain a coating weight of about 17.02 mg/in$^2$.

EXAMPLE 23

A charge transport layer (CT) formulation was prepared from 48.0 grams of PCA (MAKROLON-5208), 16.0 grams of PCZ (IUPILON-400Z), 34.46 grams of TTA in a solution of 350 grams of THF, 96 grams 1,4-dioxane and 4 drops of surfactant (DC-200 polydimethylsiloxane). One of the CG layer coated drums was dip-coated in the CT formulation and dried at 120° C. for one hour to obtain a coating weight of about 15.30 mg/in$^2$.

EXAMPLE 24

A charge transport layer (CT) formulation was prepared from 32.0 grams of PCA (MAKROLON-5208), 32.0 grams of PCZ (IUPILON-400Z), 42.67 grams of TTA in a solution of 350 grams of THF, 96 grams 1,4-dioxane and 4 drops of surfactant (DC-200 polydimethylsiloxane). Two of the CG layer coated drums were dip-coated in the CT formulation and dried at 120° C. for one hour to obtain coating weights of about 20.02 and 21.00 mg/in$^2$.

EXAMPLE 25

A charge transport layer (CT) formulation was prepared from 32.0 grams of PCA (MAKROLON-5208), 32.0 grams of PCZ (IUPILON-400Z), 34.46 grams of TTA in a solution of 350 grams of THF, 96 grams 1,4-dioxane and 4 drops of surfactant (DC-200 polydimethylsiloxane). Two of the CG layer coated drums were dip-coated in the CT formulation and dried at 120° C. for one hour to obtain coating weights of about 19.12 and 19.44 mg/in$^2$.

EXAMPLE 26

A charge transport layer (CT) formulation was prepared from 23.0 grams of PCA (MAKROLON-5208), 34.5 grams of PCZ (IUPILON-400Z), 38.3 grams of TTA in a solution of 321 grams of THF, 96 grams 1,4-dioxane and 4 drops of surfactant (DC-200 polydimethylsiloxane). Three of the CG layer coated drums were dip-coated in the CT formulation and dried at 120° C. for one hour to obtain coating weights of about 16.08, 15.70 and 15.87 mg/in$^2$.

EXAMPLE 27

A charge transport layer (CT) formulation was prepared from 23.0 grams of PCA (MAKROLON-5208), 34.5 grams of PCZ (IUPILON-400Z), 31.0 grams of TTA in a solution of 321 grams of THF, 96 grams 1,4-dioxane and 4 drops of surfactant (DC-200 polydimethylsiloxane). Three of the CG layer coated drums were dip-coated in the CT formulation and dried at 120° C. for one hour to obtain coating weights of about 15.73, 15.73 and 15.66 mg/in$^2$.

EXAMPLE 28

A charge transport layer (CT) formulation was prepared from 14.4 grams of PCA (MAKROLON-5208), 43.1 grams of PCZ (IUPILON-400Z), 38.3 grams of TTA in a solution of 321 grams of THF, 96 grams 1,4-dioxane and 4 drops of surfactant (DC-200 polydimethylsiloxane). Two of the CG layer coated drums were dip-coated in the CT formulation and dried at 120° C. for one hour to obtain coating weights of about 17.53 and 17.47 mg/in$^2$.

EXAMPLE 29

A charge transport layer (CT) formulation was prepared from 14.4 grams of PCA (MAKROLON-5208), 43.1 grams of PCZ (IUPILON-400Z), 31.0 grams of TTA in a solution of 321 grams of THF, 96 grams 1,4-dioxane and 4 drops of surfactant (DC-200 polydimethylsiloxane). Two of the CG layer coated drums were dip-coated in the CT formulation and dried at 120° C. for one hour to obtain coating weights of about 16.26 and 16.10 mg/in$^2$.

EXAMPLE 30

A charge transport layer (CT) formulation was prepared from 57.5 grams of PCZ (IUPILON-400Z), 38.3 grams of TTA in a solution of 321 grams of THF, 96 grams 1,4-dioxane and 4 drops of surfactant (DC-200 polydimethylsiloxane). Two of the CG layer coated drums were dip-coated in the CT formulation and dried at 120° C. for one hour to obtain coating weights of about 17.58 and 17.19 mg/in$^2$.

EXAMPLE 31

A charge transport layer (CT) formulation was prepared from 57.5 grams of PCZ (IUPILON-400Z), 31.0 grams of TTA in a solution of 321 grams of THF, 96 grams 1,4-dioxane and 4 drops of surfactant (DC-200 polydimethylsiloxane). Two of the CG layer coated drums were dip-coated in the CT formulation and dried at 120° C. for one hour to obtain coating weights of about 18.53 and 16.43 mg/in .

The following table provides comparative results of drums coated with formulations prepared according Examples 20–31 with respect to sensitivity and residual voltage.

TABLE 9

| Sample No. | CG Batch | Drum Coating wt. (mg/in$^2$) | TTA wt. % | Binder or PCA/PCZ (wt. ratio) | Sensitivity Voltage at E = 0.2 $\mu$J/cm$^2$ | Residual Voltage (V) |
|---|---|---|---|---|---|---|
| 1 | 1 | 16.16 | 35 | Control[1] | 319 | 177 |
| 2 | 1 | 15.43 | 40 | Control[1] | 309 | 167 |
| 3 | 1 | 15.30 | 35 | 75/25 | 375 | 242 |
| 4 | 1 | 17.02 | 40 | 75/25 | 410 | 313 |
| 5 | 1 | 19.12 | 35 | 50/50 | 392 | 290 |
| 6 | 1 | 20.02 | 40 | 50/50 | 465 | 388 |
| 7 | 1 | 15.73 | 35 | 40/60 | 412 | 277 |
| 8 | 1 | 16.08 | 40 | 40/60 | 386 | 227 |
| 9 | 2 | 15.73 | 35 | 40/60 | 373 | 259 |
| 10 | 2 | 15.70 | 40 | 40/60 | 332 | 196 |
| 11 | 2 | 16.26 | 35 | 25/75 | 291 | 164 |
| 12 | 2 | 17.53 | 40 | 25/75 | 270 | 149 |
| 13 | 2 | 18.53 | 35 | 0/100 | 322 | 213 |
| 14 | 2 | 17.58 | 40 | 0/100 | 282 | 166 |
| 15 | 3 | 16.66 | 35 | Control[1] | 269 | 115 |
| 16 | 3 | 16.17 | 40 | Control[1] | 264 | 92 |
| 17 | 3 | 19.44 | 35 | 50/50 | 318 | 191 |
| 18 | 3 | 21.00 | 40 | 50/50 | 374 | 272 |
| 19 | 3 | 15.66 | 35 | 40/60 | 345 | 209 |
| 20 | 3 | 15.87 | 40 | 40/60 | 332 | 172 |
| 21 | 3 | 16.10 | 35 | 25/75 | 290 | 125 |

TABLE 9-continued

| Sample No. | CG Batch | Drum Coating wt. (mg/in$^2$) | TTA wt. % | Binder or PCA/PCZ (wt. ratio) | Sensitivity Voltage at E = 0.2 $\mu$J/cm$^2$ | Residual Voltage (V) |
|---|---|---|---|---|---|---|
| 22 | 3 | 17.47 | 40 | 25/75 | 292 | 130 |
| 23 | 3 | 16.43 | 35 | 0/100 | 302 | 144 |
| 24 | 3 | 17.19 | 40 | 0/100 | 306 | 156 |

[1]Control was APEC-9201 binder.

As can be seen by the foregoing comparative examples, a photoreceptor containing TTA in the CTL (Sample #'s 11–12 and 21–22) performed best when the binder was a 25:75 parts by weight PCA/PCZ mixture as evidenced by the higher sensitivity and low residual voltage. Sample #'s 11–12 and 21–22 show comparable sensitivities and residual voltages to Sample #'s 15 and 16 which used APEC 9201 as a binder. However, as demonstrated with reference to Table 8, the PCA/PCZ binders outperformed the APEC 9201 binder over the print life of the coating as evidenced by the relatively stable charge and discharge voltages for drums using PCA/PCZ binder blends.

Having now described the invention and preferred embodiments thereof, it will be recognized by those of ordinary skill that the invention is capable of numerous modifications, rearrangements and substitutions without departing from the spirit and scope of the invention as defined by the appended claims.

What is claimed is:

1. An electrophotographic photoconductor composition comprising a mixture of polycarbonates of the formula:

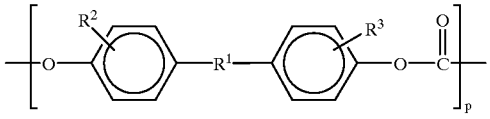

wherein $R^1$ is selected from the group consisting of $CH_2$ an alkylidene group, a cycloalkyl group and a substituted cycloalkyl group, $R^2$ and $R^3$ are selected from the group consisting of hydrogen, halogen and an a $CH_3$ group, the mixture containing (a) from about 10 to about 75% by weight of a polycarbonate (PCA) wherein $R^1$ is an alkylidene group containing from about 3 to about 5 carbon atoms, p is an integer ranging from about 20 to about 200 and the PCA has a polydispersity index of below about 2.5 and (b) from about 25 to about 90% by weight of a polycarbonate (PCZ) wherein $R^1$ is a cycloalkyl group containing from about 5 to about 8 carbon atoms, p is an integer ranging from about 15 to about 300 and the PCZ has a polydispersity index of below about 2.5.

2. The composition of claim 1 wherein the PCA has a number average molecular weight ranging from about 30,000 to about 35,000.

3. The composition of claim 2 wherein the PCZ has a number average molecular weight above about 35,000 and below about 80,000.

4. The composition of claim 1 wherein the ratio of the number average molecular weight of the PCA to the number after molecular weight of the PCZ ranges from about 1:1 to about 1:3.

5. The composition of claim 1 wherein the PCZ has a number average molecular weight above about 35,000 and below about 80,000.

6. The composition of claim 1 further comprising an additive selected from a silicone polymer and a fluoropolymer.

7. The composition of claim 2 further comprising at least one charge transport material.

8. The composition of claim 7 wherein the charge transport material is selected from the group consisting of N,N-diethylaminobenzaldehyde-1,1 -diphenylhydrazone (DEH), tri(p-tolyl)amine (TTA) and N,N'-bis(3-methylphenyl)-N,N'-bisphenylbenzidine (TPD).

9. The composition of claim 1 wherein the PCA is a polycarbonate of the formula:

10.

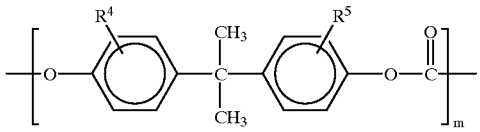

wherein $R^4$ and $R^5$ are selected from the group consisting of hydrogen, $CH_3$ and a halogen and m is an integer ranging from about 15 to about 200.

10. The composition of claim 9, wherein $R^4$ and $R^5$ are hydrogen atoms.

11. The composition of claim 1 wherein the PCZ is a polycarbonate of the formula:

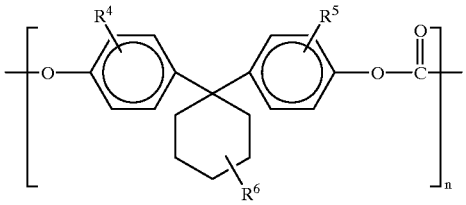

wherein $R^4$, $R^5$ and $R^6$ are selected from the group consisting of hydrogen, $CH_3$ and a halogen and n is an integer ranging from about 20 to about 300.

12. The composition of claim 11 wherein $R^4$, $R^5$ and $R^6$ are hydrogen atoms.

13. An electrophotographic photoconductor composition comprising (a) polycarbonate (PCA) of the formula:

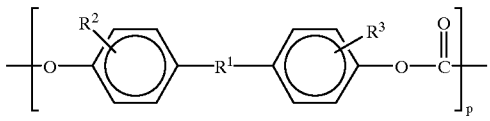

wherein $R^1$ is a methylidene group or an alkylidene group containing from about 3 to about 5 carbon atoms, $R^2$ and $R^3$ are selected from the group consisting of hydrogen, halogen and an a $CH_3$ group and p is an integer ranging from about 15 to about 200, (b) polycarbonate (PCZ) of the formula:

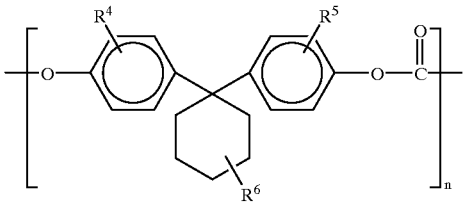

wherein $R^1$ is a cycloalkyl group containing from about 5 to about 8 carbon atoms, $R^4$, $R^5$ and $R^6$ are selected from the group consisting of hydrogen, $CH_3$ and a halogen and n is an integer ranging from about 20 to about 300, and (c) N,N-diethylaminobenzaldehyde-1,1 -diphenyl-hydrazone (DEH) or tri(p-tolyl)amine (TTA).

14. The composition of claim 13 containing from about 10 to about 75% by weight PCA, from about 25 to about 90% by weight PCZ and from about 30 to about 50% by weight DEH or TTA.

15. The composition of claim 13 further comprising an additive selected from a silicone polymer and a fluoropolymer.

16. The composition of claim 13 wherein $R^4$ and $R^5$ are hydrogen atoms.

17. The composition of claim 13 wherein $R^2$ and $R^3$ are hydrogen atoms.

18. The composition of claim 13 wherein $R^6$ is a hydrogen atom.

19. The composition of claim 13 wherein the silicone polymer comprises silicone microspheres having a mean particle diameter of about 0.5 to about 5.0 microns.

20. The composition of claim 13 wherein the fluoropolymer comprises polytetrafluoroethylene.

21. The composition of claim 13 wherein the number average molecular weight ratio of the PCA to PCZ in the composition ranges from about 1:1 to about 1:2.6.

22. An electrophotographic photoconductor composition comprising (a) polycarbonate (PCA) of the formula

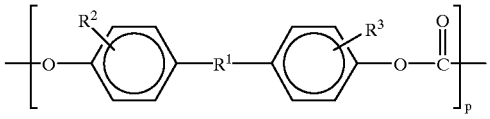

wherein $R^1$ is a methylidene group or an alkylidene group containing from about 3 to about 5 carbon atoms, $R^2$ and $R^3$ are selected from the group consisting of hydrogen, halogen and an a $CH_3$ group and p is an integer ranging from about 15 to about 200, (b) polycarbonate (PCZ) of the formula:

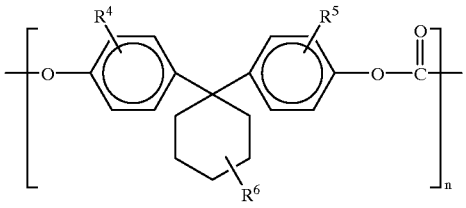

wherein $R^1$ is a cycloalkyl group containing from about 5 to about 8 carbon atoms, $R^4$ $R^5$ and $R^6$ are selected from the group consisting of hydrogen, $CH_3$ and a halogen and n is an integer ranging from about 20 to about 300, (c) a charge transport material, and (d) and additive selected from a silicone polymer and a fluoropolymer.

23. The composition of claim 22 wherein the charge transport material comprises N,N-diethylaminobenzaldehyde- 1,1-diphenyl-hydrazone (DEH).

24. The composition of claim 22 wherein the charge transport material comprises tri(p-tolyl)amine (TTA).

25. The composition of claim 22 wherein the additive comprises silicone microspheres having a mean particle diameter of ranging from about 0.5 to about 5 microns.

26. The composition of claim 22 wherein the additive comprises a fluoropolymer.

27. The composition of claim 22 wherein $R^4$ and $R^5$ are hydrogen atoms.

28. The composition of claim 22, wherein $R^2$ and $R^3$ are hydrogen atoms.

29. The composition of claim 22, wherein $R^6$ is a hydrogen atom.

30. The composition of claim 22 containing from about 10 to about 75% by weight PCA, from about 25 to about 90% by weight PCZ, from about 30 to about 40% by weight charge transport material.

31. The composition of claim 22 wherein the number average molecular weight ratio of the PCA to PCZ in the composition ranges from about 1:1 to about 1:2.6.

32. A method for improving the wear properties of a photoconductor coating on a photoreceptor drum of an electrophotographic printer, the method comprising dissolving from about 10 to about 75% by weight of polycarbonate-A with from about 25 to about 90% by weight of polycarbonate-Z (PCZ) based on the weights of PCA and PCZ in a solvent containing a charge transport material to provide a charge transport (CT) composition and coating a drum containing a charge generation material layer with the charge transport composition, wherein the number average molecular weight ratio of the PCA to PCZ in the CT composition ranges from about 1:1 to about 1:2.6.

33. The method of claim 32 wherein the PCA has a number average molecular weight ranging from about 30,000 to about 35,000.

34. The method of claim 33 wherein the PCZ has a number average molecular weight above about 35,000 and below about 80,000.

35. The method of claim 32 wherein the PCZ has a number average molecular weight above about 35,000 and below about 80,000.

36. The method of claim 32 further comprising a silicone polymer or a fluoropolymer to the CT composition.

37. The method of claim 32 wherein the charge transport material is selected from the group consisting of N,N-diethylaminobenzaldehyde-1,1 -diphenylhydrazone (DEH), tri(p-tolyl)amine (TTA) and N,N'-bis(3-methylphenyl)-N, N'-bisphenylbenzidine (TPD).

38. The method of claim 32 wherein the PCA is a polycarbonate of the formula:

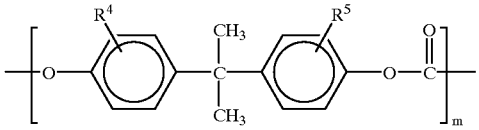

wherein $R^4$ and $R^5$ are selected from the group consisting of hydrogen, $CH_3$ and a halogen and m is an integer ranging from about 15 to about 200.

39. The method of claim 38 wherein $R^4$ and $R^5$ are hydrogen atoms.

40. The method of claim 32 wherein the PCZ is a polycarbonate of the formula:

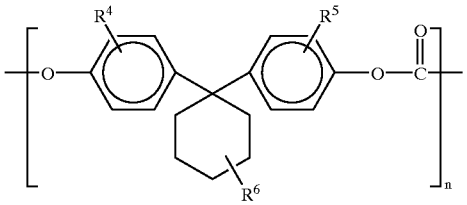

wherein $R^4$ $R^5$ and $R^6$ are selected from the group consisting of hydrogen, $CH_3$ and a halogen and n is an integer ranging from about 20 to about 300.

41. The method of claim 40 wherein $R^4$, $R^5$ and $R^6$ are hydrogen atoms.

* * * * *